United States Patent [19]

Komatu

[11] 4,108,305

[45] Aug. 22, 1978

[54] TAPE-MOUNTED ELECTRONIC-COMPONENT PACKAGE

[75] Inventor: Kisao Komatu, Tokyo, Japan

[73] Assignee: Tokyo Denki Kagaku Kogyo Kabushiki Kaisha, Japan

[21] Appl. No.: 763,487

[22] Filed: Jan. 28, 1977

[30] Foreign Application Priority Data

Jan. 30, 1976 [JP] Japan ..... 51-9077

[51] Int. Cl.[2] ..... B65D 73/02

[52] U.S. Cl. ..... 206/330

[58] Field of Search ..... 206/330, 328, 344, 395, 206/411, 346

[56] References Cited

U.S. PATENT DOCUMENTS

| | | | |
|---|---|---|---|
| 2,882,084 | 2/1958 | Eilertsen | 206/409 |
| 2,991,958 | 7/1961 | Eifrid | 206/409 |
| 3,231,082 | 1/1966 | Weiss | 206/330 |
| 3,541,052 | 11/1970 | Kirk | 206/395 |
| 3,587,840 | 6/1971 | Hultberg | 206/395 |

FOREIGN PATENT DOCUMENTS

| | | | |
|---|---|---|---|
| 993,282 | 7/1951 | France | 206/395 |
| 266,654 | 8/1929 | Italy | 206/395 |

*Primary Examiner*—Herbert F. Ross

*Attorney, Agent, or Firm*—Blum, Moscovitz, Friedman & Kaplan

[57] ABSTRACT

Electronic components having parallel leads are mounted equidistantly by means of said leads on tape. The tape is wound in a spiral and packaged in a box prepared from a box blank. The box has a hinged opening in the side thereof through which the tape and the electronic components mounted thereon can be fed either manually or automatically without opening the package itself.

7 Claims, 4 Drawing Figures

TAPE-MOUNTED ELECTRONIC-COMPONENT PACKAGE

BACKGROUND OF THE INVENTION

The present invention relates to a package of electronic components mounted on tape of a predetermined length. The components are typically condensers or resistors having parallel lead wires and the electronic components are mounted on the tape by means of said lead wires.

With recent development of automatic machines for production of electronic components, it becomes possible to manufacture such electronic components in great numbers, at high speed and to mount them automatically on tape. Using the lead wires as the mounting means, such electronic components are held equidistantly on a paper strip using an adhesive tape as the mounting means.

In general, the strip or tape is spirally-wound on a winding frame or core and transported and stored in this spirally-wound state. It can then be fed to an automatic inserting machine to be used in preparing printed circuits with the electronic components being removed from the tape as required, the electronic components being cut one by one and inserted at the specified positions into printed circuits. The transport and storage of the spirally-wound tape has presented some problems due to the fact that in the normal mounting arrangement electronic components protrude from one or both edges of the tape making them subject to damage. Naturally, sections of spirally-wound tape carrying components can be packaged, but then it becomes necessary to open each individual package and remove the tape therefrom as the tape is to be delivered to an automatic inserting machine. The manual handling of the packages is expensive and introduces the possibility of mistakes due to human error. Consequently, a package from which the tape could be fed without opening same is eminently desirable. Such a package should also be designed to protect the tape from dust and accidental contact either manual or with moisture, for instance, during the process of feeding tape to the automatic inserting machine with which it is to be used.

SUMMARY OF THE INVENTION

A package which can be assembled from a box blank has a cover which can be lifted to insert a spiral of tape holding electronic components. Mounted on the inside bottom of the package is an axial core on which can be mounted rotatably a winding core on which is wound a spiral of tape. If desired, a second axial core can be mounted in a corresponding position on the inside surface of the box cover so that both ends of the winding core may be precisely positioned.

The box has a hinged opening proximate one of the corners at which the cover is hinged. Through this opening can be pulled and fed the tape bearing components. The feeding of the tape can be effected without lifting the cover of the box, thereby protecting the contents thereof from accidental deleterious contact.

In a preferred embodiment the tape has punched holes therein at distances corresponding to the distances between electronic components, said punched holes serving for receiving driving means for moving the tape along at a rate corresponding to that at which the machine to which the tape is being fed is operating.

Accordingly, an object of the present invention is a package which can be assembled from a box blank and from which a spirally-wound tape having mounted thereon an electronic component can be fed without opening the cover of said box.

Another object of the present invention is an inexpensive box for containing a spirally-wound tape having mounted thereon electronic components during transport and storage and having a small hinged opening through which the tape and the components can be fed at a rate corresponding to the operating speed of the machine to which the tape and its components are being fed.

A further object of the present invention is a package and spirally-wound tape in said package, said spirally-wound tape having mounted thereon electric components, said spiral of tape containing a spacer tape to compensate for the thickness of the electronic components on said tape, thereby insuring that the spiral of tape is essentially cylindrical rather than frustoconical in shape.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
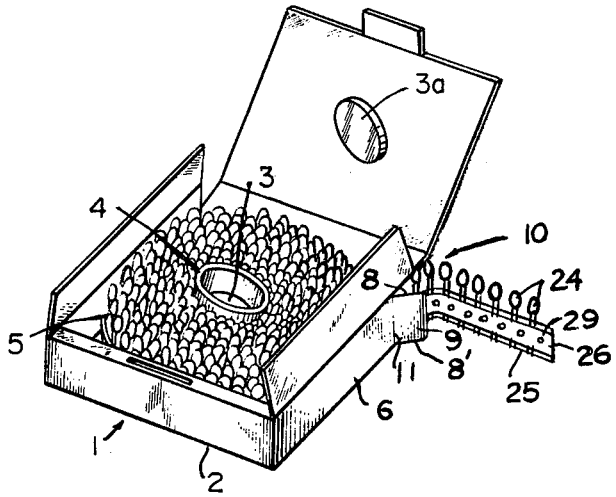
FIG. 1 is a perspective view of a package in accordance with the present invention including a spirally-wound tape having condensers mounted thereon.
Figure 4:
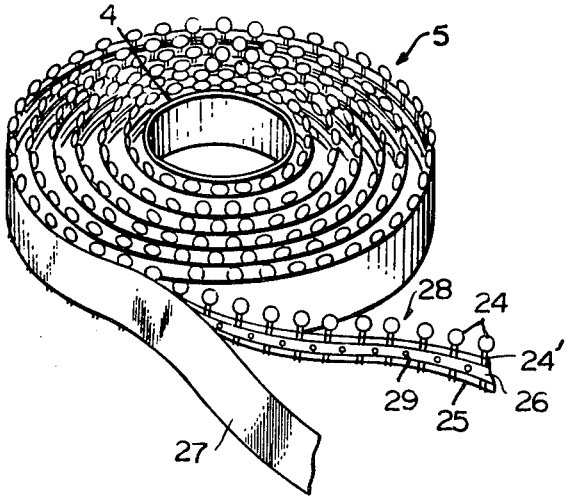
FIG. 4 is a perspective view of a spirally-wound tape in accordance with the present invention having electronic components mounted thereon and including a spacer tape for shaping said spiral.

Referring now to FIG. 1, a disc-like axial core 3 is fixed to bottom section 2 of package box indicated generally by the reference numeral 1, and cylindrical winding core 4 is rotatably mounted on axial core 3. Wound around cylindrical winding core 4 is a tape 25 on which are mounted electronic components 24 each having a set of parallel lead wires 24' (FIG. 4), the sets of lead wires being spaced equidistantly and held to tape 25 by adhesive tape 26. The tape 25, holding the electronic components, is wound in a spiral 5 around winding core 4. As shown in FIG. 1 hinged flap 9 rotates around score line 11 to produce an opening indicated generally by the reference numeral 10 through which the tape can be pulled. Hinged flap 9, as shown in FIG. 1, is the end portion of side face 6 and can be swung outwardly due to the fact that slits 8 and 8' have been cut in the score lines between bottom section 2 and side face 6 on the one hand and between side face 6 and top support flap 18 (FIG. 2) on the other hand.

Figure 2:
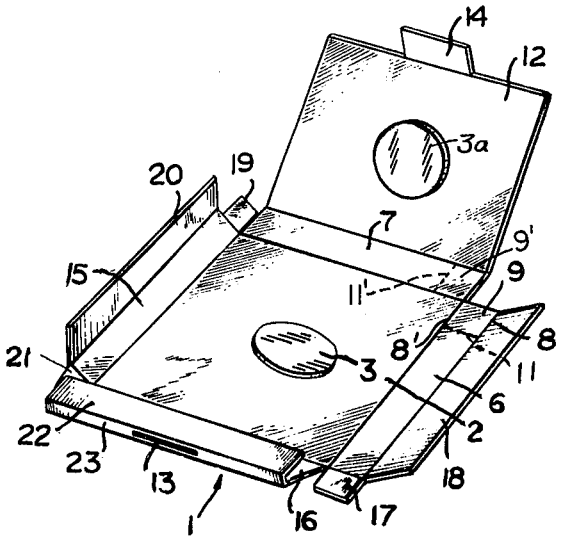
FIG. 2 is a perspective view of a box blank from which the package of FIG. 1 can be assembled.

The package of FIG. 1 can be prepared from a flat box blank, except for axial core 3, as shown in FIG. 2. Box 1 consists essentially of bottom section 2 having a front face 16 , a back face 7 and side faces 6 and 15. Front face 16 continues into a top support section 23 and an inside front face 22. Similarly, side face 15 continues into top support flap 20 while side face 6 continues into top support flap 18. In the same manner, back face 7 continues into cover section 12 to which is connected tongue 14. As shown in FIG. 2, side face 15 has end flaps 19 and 21 and side face 6 has a single end flap 17. All faces, sections, flaps, etc., are separated by score lines which can be seen in FIG. 2 but which are not numbered.

In each case, the score lines are so disposed as to facilitate folding the various sections, flaps, etc., inwardly so as to prepare the package as shown in FIG. 1. The single exception is the score line 11 which is disposed so that hinged flap 9 can be folded outwardly for drawing the end of the spiral tape from the box without lifting the cover 12.

In assembling the box, as can be seen, end flaps 17 and 21 fit between front face 16 and inside front face 22. End flap 19 fits against the inside of back face 7 and can be glued thereto if desired. Top support flaps 18 and 20 fold over onto the electronic components 24 and support the cover 12.

While the hinged flap 9 is shown as part of side face 6, a similar hinged flap 9' could just as readily be cut in back face 7 at the right-hand edge thereof as shown in FIG. 2. Obviously, it would be necessary to cut through the score lines between bottom section 2 and back face 7 and between back face 7 and cover section 12 in order to make it possible to open out flap 9'. Score line 11' would be disposed for folding flap 9' outwardly.

While axial core 3 will suffice to hold winding core 4, a similar core, 3*a* can be placed on a corresponding portion of the inside face of cover 12 to hold the upper end of winding core 4. Axial cores 3 and 3*a* can be of paper, or plastic or any other convenient material. Where the package is of plastic, axial cores 3 and 3*a* can be molded as part of the blank.

Figure 3:
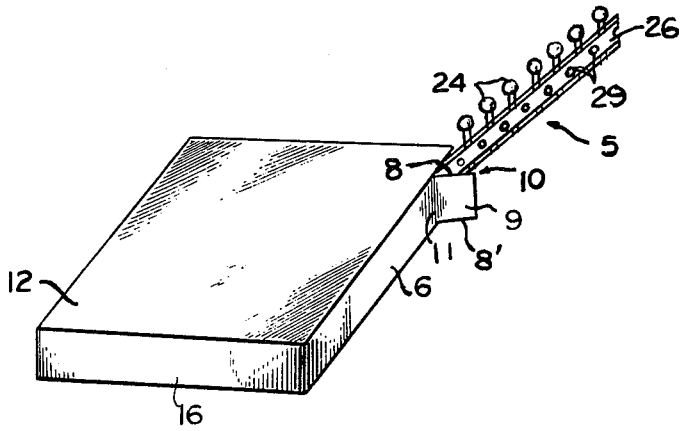
FIG. 3 is a perspective view of a package in accordance with the present invention showing tape with components mounted thereon being fed from said package through a small, hinged opening.

FIG. 3 shows tape holding electronic components being fed from the package in accordance with the present invention. Punched holes 29 through adhesive tape 26, and if desired, through tape 25 can be used for drawing the tape incrementally, using a sprocket device of known form.

As the tape is wound into a spiral in preparation for insertion into the package, the thickness of the components may distort the winding, changing the form of the spiral from the desired near-cylindrical form to an essentially frustoconical form. To prevent this a tape 27 of appropriate thickness can be wound with tape 25 to compensate for the thickness of components 24, thereby keeping the tape essentially parallel to the axis of the spiral and, to the axis of the cylinder 4.

Support strip 25 is of a relatively flexible material such as paper tape and the back surface of strip 25 is flat except for those portions where the shifting or positioning holes 29 are formed, thereby providing for winding the tape on the winding core easily and regularly. The width of the adhesive tape 26 should be somewhat smaller than the width of the support strip 25 thereby making it possible to measure the properties of the electronic components 28 by means of exposed portions of the leads. The leads generally are in sets of two but may be in sets of three for transistors or various other electronic components. The openings 29 are formed in strips 25 and 26 at precisely equidistant spacings and generally along the mid-portion of the strip as measured transversely.

As is evident from the foregoing illustrations, the package of the present invention comprises at least one axial core mounted on the inner face of a package box with a winding core rotatably mounted on same. A series of electronic components is spirally wound on the periphery of the winding core and at least one opening is formed in a side section of the package box for feeding out the series of electronic components held on a spirally wound strip. As a result of this type of packaging a desired length of a series of electronic components can very readily be packaged as a single unit on a winding core and automatic packaging becomes possible. Furthermore, damage to the packaged electronic components is effectively prevented, and the number to be used at any given time can be readily fed from the container. Furthermore, the entire package can be fed to an automatic machine for inserting electronic components into printed circuits.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A box blank for a package for feeding a spirally-wound support tape carrying electronic components held to said support tape by lead wires disposed transversely to said support tape, comprising an essentially square bottom section, a back face and a front face at two opposed edges of said bottom section, said back and front faces each having two edges, first and second side faces at the remaining edges of said bottom section, score lines between each of said faces and said bottom section, each of said side faces having two ends and two edges, an end flap at each end of said first side face, a score line between each of said end flaps and said first side face, a single end flap at that end of said second side face nearer said front face, a score line between said single end flap and said second side face, a cover section of essentially the same size and shape as said bottom section at an edge of said back face, a score line between said cover section and said back face, a tongue at the edge of said cover section opposite that adjacent to said back face, a score line between said tongue and said cover section, a top support flap at an edge of each of said side faces, a score line between each of said side faces and the respective top support flap, a top support section and an inside front face in sequence at said front face, score lines between said front face and said top support section and between said top support section and said inside front face, said top support section having a slot therein for receiving said tongue on said cover section to hold said cover section in closed position when said box blank is assembled, all of said score lines being positioned for folding an inward direction, one of that end of said back face nearer said second side face and that end of said second side face nearer said back face each having a score line transverse to the edges thereof and a short distance from each said that end positioned for folding outward and the edges of said back face and said side face being cut through from said that end to said transverse score line for forming a hinged flap which can open outwardly from said box either from said back or said side face when formed from said box blank for permitting feed of spirally-wound contents from a box made from said blank, and an axial core attached to said bottom section for use in holding said spirally-wound support tape.

2. The box blank as claimed in claim 1, further comprising a winding core rotatably mounted on said axial core.

3. The box blank as claimed in claim 1, further comprising a second axial core mounted on said cover section for cooperating with said axial core for rotatably mounting said spirally-wound support tape.

4. The box blank as claimed in claim 2, further comprising a second axial core mounted on said cover section for cooperating with said axial core for rotatably mounting said spirally-wound support tape.

5. The box blank as claimed in claim 2, further comprising a tape, electronic components having sets of parallel leads, and adhesive tape holding said sets of parallel leads spaced apart equidistantly against said tape and thereby said electronic components being at uniform spacing, said tape being spirally-wound on said axial core.

6. The box blank as claimed in claim 5, further comprising a spacer tape over said leads but not over said components and spirally wound with said tape and said components, the thickness of said spacer tape being such as to compensate for the thickness of said components whereby said tapes in being spirally wound become essentially cylindrical rather than essentially frustoconical.

7. The box blank as claimed in claim 5, wherein said tape has punched openings therein at regular intervals corresponding to the distance between sets of parallel leads for use in transporting said tape.

* * * * *